US010236102B2

(12) United States Patent
Ren et al.

(10) Patent No.: US 10,236,102 B2
(45) Date of Patent: Mar. 19, 2019

(54) LIGHTNING ARRESTER

(71) Applicant: Tyco Electronics (Shanghai) Co. Ltd., Shanghai (CN)

(72) Inventors: Xiaopeng Ren, Shanghai (CN); Lizhang Yang, Shanghai (CN); Rong Zhang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 57 days.

(21) Appl. No.: 15/214,770

(22) Filed: Jul. 20, 2016

(65) Prior Publication Data

US 2016/0329137 A1 Nov. 10, 2016

Related U.S. Application Data

(63) Continuation of application No. PCT/IB2015/050176, filed on Jan. 9, 2015.

(30) Foreign Application Priority Data

Jan. 22, 2014 (CN) ..... 2014 2 0040346 U

(51) Int. Cl.

| | |
|---|---|
| ***H01C 7/112*** | (2006.01) |
| ***H01C 7/12*** | (2006.01) |
| ***H01T 1/15*** | (2006.01) |
| ***H01C 1/02*** | (2006.01) |
| ***H01C 1/14*** | (2006.01) |

(52) U.S. Cl.

CPC ..... *H01C 7/126* (2013.01); *H01C 1/02* (2013.01); *H01C 1/14* (2013.01); *H01T 1/15* (2013.01); *H01C 7/112* (2013.01)

(58) Field of Classification Search

CPC ..... H01C 7/126; H01C 7/112; H01C 1/02; H01C 1/14; H01C 1/15

USPC ..... 338/21, 13

See application file for complete search history.

(56) References Cited

U.S. PATENT DOCUMENTS

| | | | | |
|---|---|---|---|---|
| 3,588,578 A | | 6/1971 | Clinkenbeard | |
| 3,803,524 A | | 4/1974 | Schmalz et al. | |
| 4,001,651 A | * | 1/1977 | Kershaw, Jr. | H01T 1/15 361/117 |
| 4,136,299 A | | 1/1979 | Nagai et al. | |
| 4,463,405 A | * | 7/1984 | Koch | H01C 7/126 315/36 |
| 4,910,632 A | * | 3/1990 | Shiga | H01C 7/126 361/117 |
| 5,113,306 A | * | 5/1992 | Veverka | H01C 7/12 361/117 |
| 5,191,503 A | * | 3/1993 | Kawamura | H01C 7/126 174/2 |
| 5,596,308 A | * | 1/1997 | Bock | H01C 7/12 338/20 |

OTHER PUBLICATIONS

International Search Report, Intl Application No. PCT/IB2015/050176, dated Apr. 14, 2015, 3 pages.

* cited by examiner

*Primary Examiner* — Kyung Lee
(74) *Attorney, Agent, or Firm* — Barley Snyder

(57) ABSTRACT

A lightning arrester is disclosed. The lightning arrester comprises a housing, a body partially disposed in the housing, a cap disposed at a first end of the housing, and an elastic element compressed between the cap and the body.

18 Claims, 3 Drawing Sheets

LIGHTNING ARRESTER

CROSS-REFERENCE TO RELATED APPLICATIONS

This application is a continuation of PCT International Application No. PCT/IB2015/050176, filed on Jan. 9, 2015, which claims priority under 35 U.S.C. § 119 to Chinese Patent Application No. 201420040346.X, filed on Jan. 22, 2014.

FIELD OF THE INVENTION

The invention relates to a lightning arrester, and more particularly, to a lightning arrester including a pressure relief device.

BACKGROUND

Lightning arresters are installed in gas insulation switchgears ("GIS"), such as those used in power stations or substations, to protect electrical equipment from abnormal voltages which may arise from lightning strikes. Known lightning arresters, used for voltages below 66 kV, have a standard upper plug interface and an overvoltage protection device disposed in an interior of the arrester. The overvoltage protection device has ZnO resistance pieces. Some known lightning arresters also have a pressure relief function, however, the electrical field distribution in such a known arrester is very uneven, which can impair the reliability of arrester performance and long-term running stability.

SUMMARY

An object of the invention, among others, is to provide a lightning arrester which can relieve pressure while optimizing an electrical distribution within the arrester. The disclosed lightning arrester comprises a housing, a body partially disposed in the housing, a cap disposed at a first end of the housing, and an elastic element compressed between the cap and the body.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a lightning arrester. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
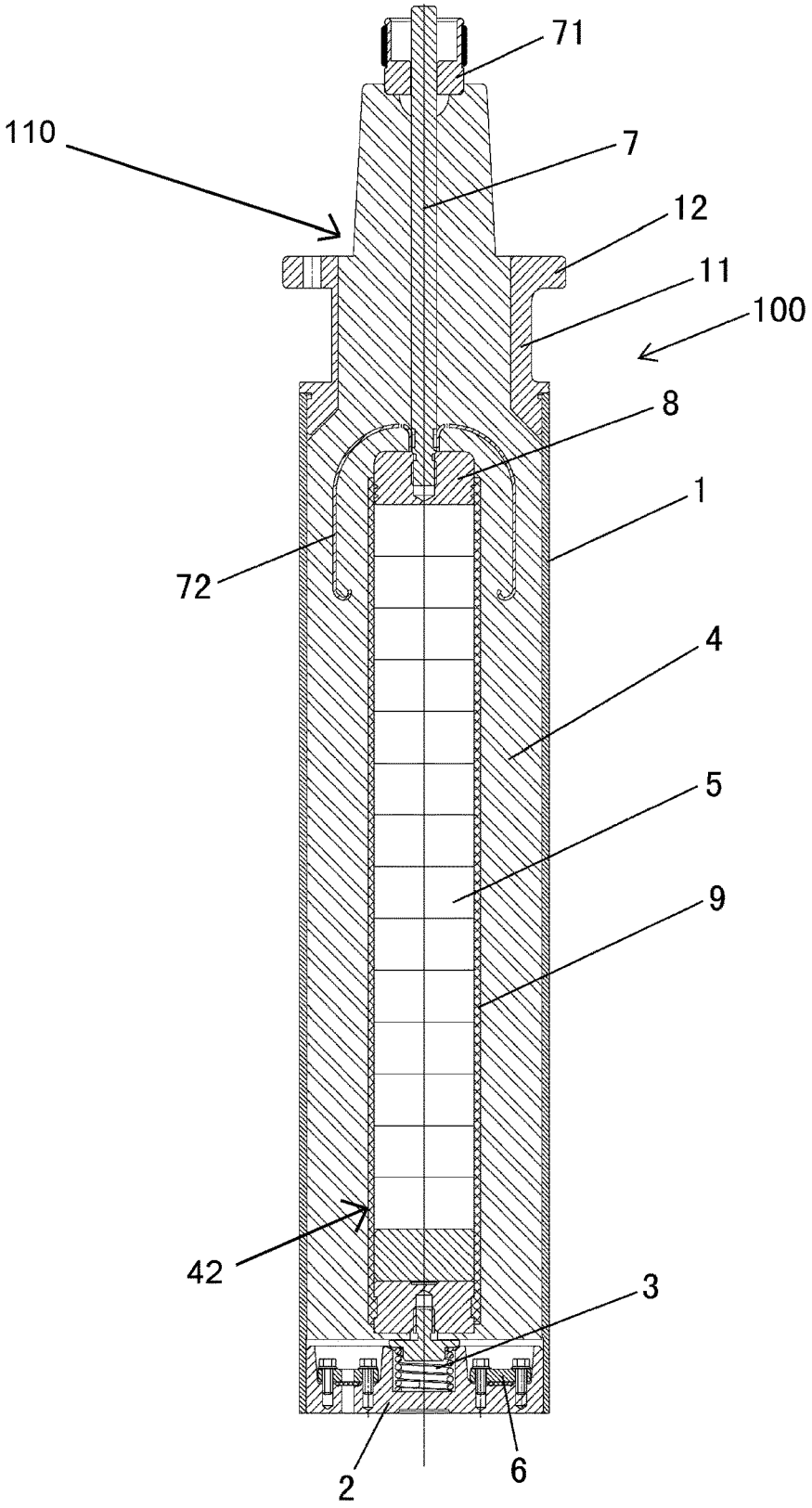
FIG. 1 is a sectional view of a lightning arrester according to the invention.

A lightning arrester 100 is shown generally in FIG. 1. The lightning arrester 100 includes a housing 1, a cap 2, an elastic element 3, a body 110, and a pressure relief device 6. The major components of the invention will now be described in greater detail.

Figure 2:
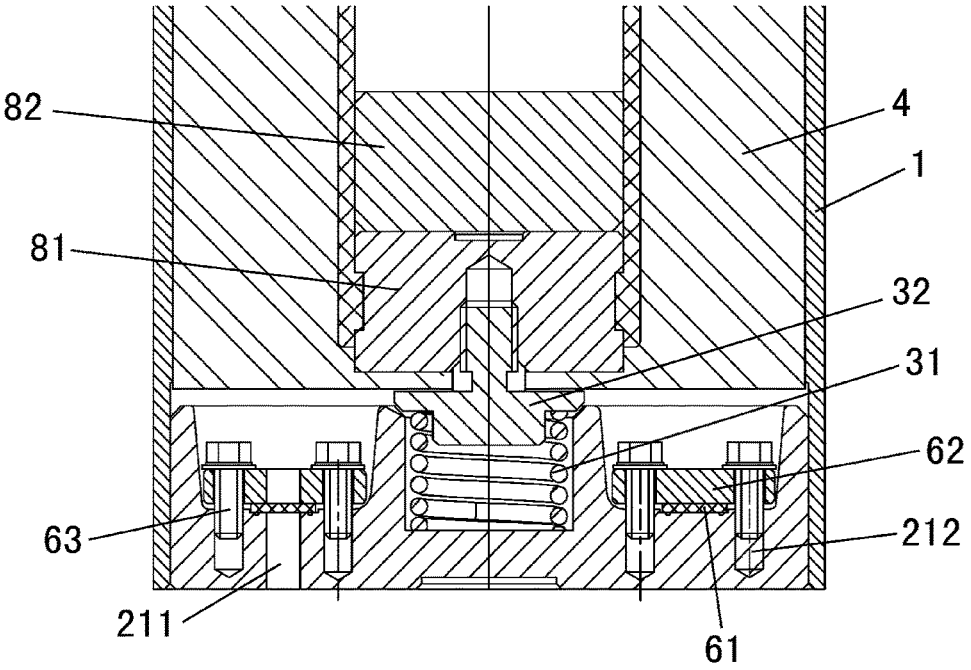
FIG. 2 is a detailed sectional view of a portion of the lightning arrester of FIG. 1.
Figure 3:
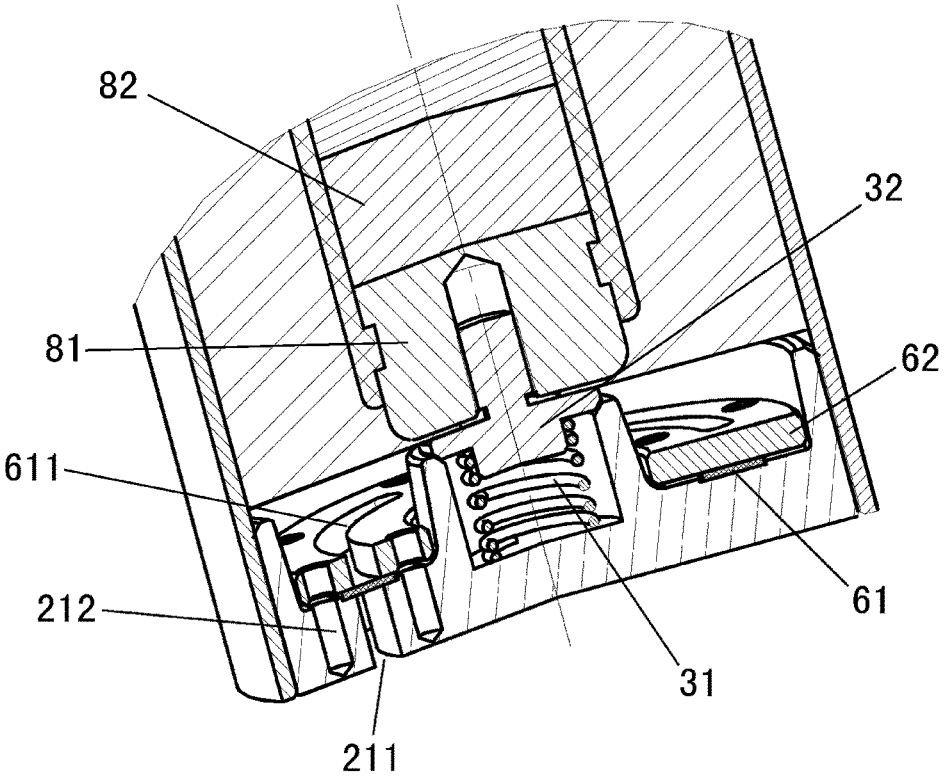
FIG. 3 is a detailed perspective sectional view of a portion of the lighting arrester of FIG. 1.

The housing 1 is a hollow cylinder, as shown in FIGS. 1-3, and has a lower first end and an upper second end. The housing 1 is a metallic material, and may be an aluminum alloy, or any other metallic material known to those with ordinary skill in the art. In the embodiment shown in FIG. 1, the second end of the housing 1 is connected to an auxiliary housing 11 having a flange 12.

Figure 4:
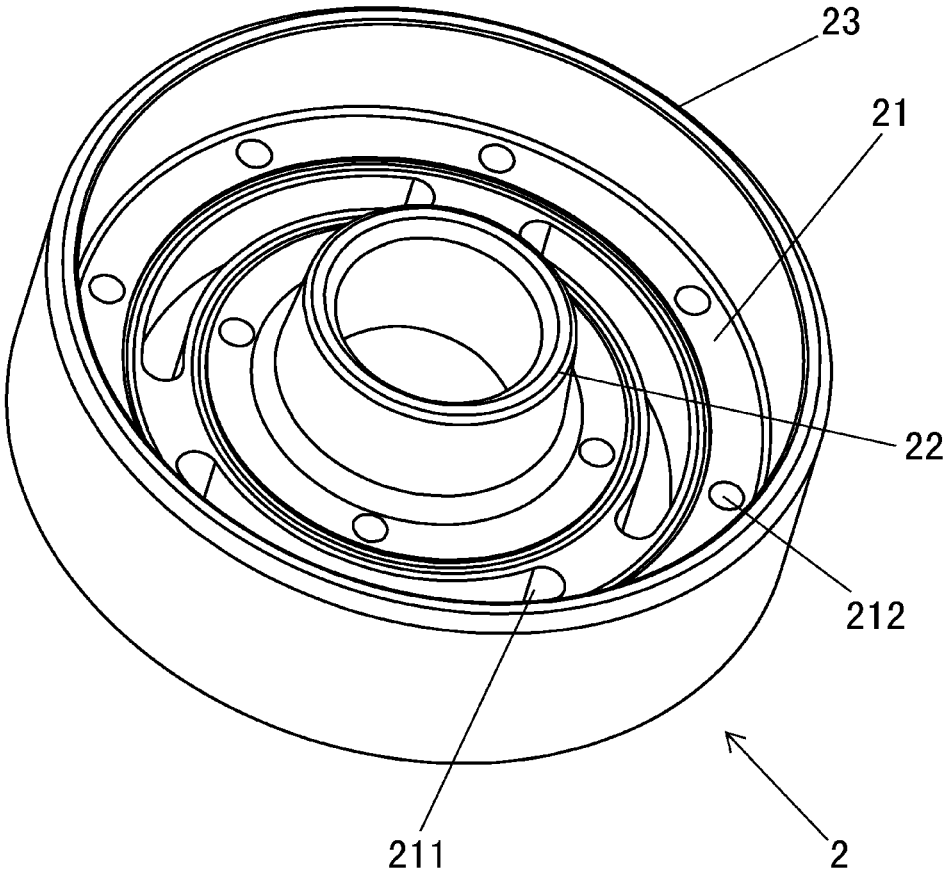
FIG. 4 is a perspective view of a cap of the lightning arrester of FIG. 1.

The cap 2 is shown in FIGS. 1-4. As best shown in FIG. 4, the cap 2 has a circular base 21, a mounting portion 22 formed at a substantial center of the base 21, and an outer wall 23 extending from the circumference of the base 21. The base 21 has first through holes 211, which fully extend through the base 21 as shown in FIG. 2. The first through holes 211 are substantially arc shaped. The base 21 also has fastener receiving passageways 212. The mounting portion 22 is a hollow cylinder projecting around the center of the base 21. The cap 2 is a metallic material, and may be an aluminum alloy, or any other metallic material known to those with ordinary skill in the art.

The elastic element 3 is shown in FIGS. 1-3 and has a spring 31 and an engaging part 32. The spring 31 may be made from stainless steel or any other elastic material known to those with ordinary skill in the art. The engaging part 32 has a substantially T-shaped cross-section with a lower first end and an upper second end extending from both sides of a disc-shaped portion. As shown best in FIGS. 2 and 3, the first end of the engaging part 32 is disposed within an upper second end of the spring 31.

The body 110 is shown in FIG. 1 and includes an insulator 4, a plurality of resistance pieces 5, a plurality of electrodes 7, a plurality of connectors 8, and a fixing cylinder 9.

The insulator 4 has a lower first end and an upper second end, and as shown in FIG. 1, includes a cylindrical receiving portion 42 formed within the insulator 4 extending inward from the first end. The insulator is made from an insulating material such as silicone rubber.

The plurality of resistance pieces 5 are disposed within the cylindrical receiving portion 42. The plurality of resistance pieces 5 may be made of a ZnO material, or any other material with high resistance known to those with ordinary skill in the art.

The plurality of electrodes 7 are made of a conductive material and extend through the insulator 4 from the second end of the insulator 4 to an upper end of the cylindrical receiving portion 42, as shown in FIG. 1. The plurality of electrodes 7 have a shielding cover 72 disposed at a lower first end adjacent the cylindrical receiving portion 42, and a contact 71 disposed at an upper second end adjacent to the second end of the insulator 4. The shielding cover 72 has a substantially bell shape and extends from the first end of the electrodes 7 toward the resistance pieces 5. The contact 71 is electrically connected to the electrodes 7.

At least one connector 8 of the plurality of connectors 8 is disposed at each of a lower first end and an upper second end of the plurality of resistance pieces 5. A first connector 8 at the second end is connected to the plurality of electrodes 7. A second connector 81 and a third connector 82, as shown in FIGS. 2 and 3, are disposed at the first end. The third connector 82 is positioned between the second connector 81 and the first end of the resistance pieces 5.

The fixing cylinder 9, as shown in FIG. 1, is disposed within the cylindrical receiving portion 42 and surrounds the resistance pieces 5 and at least a portion of the connectors 8.

The pressure relief device 6, as shown in FIGS. 1-3, has annular films 61 and an annular holding part 62. The annular films 61 are made of a rubber material. The annular holding part 62 is made of a metal material and has a second through hole 611, which is substantially arced shaped.

The assembly of the lightning arrester 100 will now be described with reference to FIGS. 1-3.

The body 110 is partially mounted in the housing 1; the first end of the insulator 4 is mounted in the first end of the housing 1 and the second end of the insulator 4 protrudes from the second end of the housing 1. The body 110 may be molded as a single piece which is mounted in the housing 1, or may be assembled from individual pieces.

The cap 2 is mounted at the first end of the housing 1. The elastic element 3 is compressed between the cap 2 and the body 110. The first lower end of the spring 31 is mounted within the mounting portion 22 and the engaging part 32 abuts the body 110. The second end of the engaging part 32 is attached or screwed to the second connecting part 81, as best shown in FIGS. 2 and 3.

The pressure relief device 6 is disposed within the cap 2. The holding part 62 is mounted on the base 21, via fasteners 63 extending through the fastener receiving passageways 212, such that the second through hole 611 aligns with the first through hole 211. The holding part 62 holds the annular films 61 on the base 21 to cover the first through holes 211.

The assembled lightning arrester 100 can be installed on electrical equipment through a plurality of connecting holes (not shown) formed in the flange 12.

In the lightning arrester 100 of the embodiments of the invention, the body 110 of the lightning arrester is effectively sealed and isolated from the outer environment by the annular films 61. When the energy of an overvoltage applied across the lightning arrester 100 is beyond a predetermined energy which the lightning arrester 100 can withstand, dynamic thermal balance of the lightning arrester 100 is broken and thus an explosion occurs, causing the annular films 61 between the holding part 62 and the base 21 of the cap 2 to be cracked. In this case, each of the first through holes 211 communicates with the corresponding one of the second through holes 611 to form the pressure relief passage, so that gas may be directed through first through holes 211 and second through holes 611, and thus directional pressure relief may be obtained.

Advantageously, according to the lightning arrester 100 of the present invention, damage of equipment due to explosive fragments of the lightning arrester 100 is avoided due to the directional pressure relief. Further, the elastic element 3 disposed at the bottom of the housing 1 is elastically compressed between the body 110 and the cap 2 to form a reliable connection such that overvoltage is released smoothly to the ground through the cap 2 and the grounded housing 1. The housing 1 forms a fully sealed metal shield having a standard interface at the second end for engaging with an inner cone insulator of a GIS. Additionally, the bell shaped shielding cover 72 acts as a pressure equalizer in the lightning arrester 100, optimizing the electrical field distribution inside the lightning arrester 100 and increasing the operating life thereof.

What is claimed is:

1. A lightning arrester, comprising:

a housing;

a body partially disposed in the housing;

a cap disposed at a first end of the housing, the cap having a base with an outer wall extending circumferentially around the base and a mounting portion shaped as a cylinder at a center of the base projecting from the base, the base, the outer wall and the mounting portion being monolithically formed of a single piece; and an elastic element compressed between the cap and the body, a portion of the elastic element being disposed within the mounting portion.

2. The lightning arrester of claim 1, wherein a first end of the elastic element is disposed on the mounting portion and a second end of the elastic element abuts the body.

3. The lightning arrester of claim 2, wherein the elastic element has a spring and an engaging part, a first end of the engaging part being engaged with a second end of the spring.

4. The lightning arrester of claim 3, wherein a first end of the spring is disposed in the cylinder and a second end of the engaging part is disposed in the body.

5. The lightning arrester of claim 4, wherein the body has an insulator with a first portion mounted in the housing and a second portion protruding from a second end of the housing.

6. The lightning arrester of claim 5, wherein the first portion of the insulator has a receiving portion.

7. The lightning arrester of claim 6, further comprising a plurality of resistance pieces disposed in the receiving portion.

8. The lightning arrester of claim 7, further comprising a plurality of connectors, at least one connector disposed at each end of the plurality of resistance pieces.

9. The lightning arrester of claim 8, further comprising an electrode passing through the second portion of the insulator and connected to one of the plurality of connectors.

10. The lightning arrester of claim 9, wherein the second end of the engaging part is fastened to one of the plurality of connectors.

11. The lightning arrester of claim 10, further comprising a shielding cover having a substantially bell shape extending from an end of the electrode towards the resistance pieces.

12. The lightning arrester of claim 9, further comprising a fixing cylinder disposed in the receiving portion and surrounding the plurality of resistance pieces.

13. The lightning arrester of claim 1, further comprising a pressure relief device disposed on the cap.

14. The lightning arrester of claim 13, wherein the pressure relief device has an annular film and an annular holding part holding the annular film on the base.

15. The lightning arrester of claim 14, wherein the base has a first through hole.

16. The lightning arrester of claim 15, wherein the annular holding part has a second through hole aligned substantially with the first through hole.

17. The lightning arrester of claim 16, wherein the annular film covers the first through hole and the second through hole and is configured to crack when the pressure between the body and the cap is greater than a predetermined value.

18. The lightning arrester of claim 17, wherein the first through hole and the second through hole have substantially arc shaped cross-sections.

* * * * *